US006735974B2

(12) United States Patent
Oh

(10) Patent No.: US 6,735,974 B2
(45) Date of Patent: May 18, 2004

(54) WATER DISTRIBUTING PIPE FOR ICE MAKING DEVICES OF REFRIGERATORS

(75) Inventor: Jae-Sek Oh, Kwangju (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 10/321,525

(22) Filed: Dec. 18, 2002

(65) Prior Publication Data

US 2004/0011071 A1 Jan. 22, 2004

(30) Foreign Application Priority Data

Jul. 19, 2002 (KR) ..... 2002-42622

(51) Int. Cl.[7] ..... F25C 1/00

(52) U.S. Cl. ..... 62/347; 62/353; 62/72; 239/518

(58) Field of Search ..... 62/347, 74, 353, 62/72; 239/518, 521, 522, 573, 524

(56) References Cited

U.S. PATENT DOCUMENTS

| | | | | |
|---|---|---|---|---|
| 3,835,661 A | * | 9/1974 | Kochendorfer et al. | 62/340 |
| 4,233,819 A | * | 11/1980 | Stottmann | 62/349 |
| 5,253,487 A | * | 10/1993 | Oike | 62/353 |
| 5,697,222 A | * | 12/1997 | Lee | 62/66 |
| 5,904,054 A | | 5/1999 | Lee | |
| 5,946,924 A | * | 9/1999 | Kim | 62/189 |
| 6,044,658 A | | 4/2000 | Ryu | |
| 6,058,720 A | * | 5/2000 | Ryu | 62/135 |
| 6,153,105 A | * | 11/2000 | Tadlock et al. | 210/650 |
| 6,370,904 B2 | * | 4/2002 | Tchougounov et al. | 62/353 |
| 6,438,988 B1 | * | 8/2002 | Paskey | 62/353 |
| 6,474,094 B2 | * | 11/2002 | Kim | 62/441 |
| 6,526,763 B2 | * | 3/2003 | Tchougounov et al. | 62/71 |

FOREIGN PATENT DOCUMENTS

| | | | |
|---|---|---|---|
| DE | 43 28 735 A1 | | 3/1995 |
| EP | 0 919 472 A1 | | 6/1999 |
| FR | 2 822 147 | | 9/2002 |
| GB | 2 299 657 | | 10/1996 |
| GB | 2 300 703 | | 11/1996 |
| JP | 407332821 A | * | 12/1995 |
| KR | 20-212608 | | 2/2001 |

OTHER PUBLICATIONS

English Translation of Abstract of Korean Patent Publication 2001–19693.
English Translation of Abstract of Korean Patent Publication 2001–37548.

* cited by examiner

*Primary Examiner*—William E. Tapolcai
*Assistant Examiner*—Mohammad M. Ali
(74) *Attorney, Agent, or Firm*—Staas & Halsey LLP

(57) ABSTRACT

A water distributing pipe for ice making devices of refrigerators which includes an ice cube tray provided such that a top portion thereof is open receiving water into the tray and opposite ends are rotatably supported to an inside of a freezer compartment and a water supply pipe supplying the water to the ice cube tray. The water distributing pipe is connected to an end of the water supply pipe distributing water to the ice cube tray. The water distributing pipe comprises a connecting part connected to the water supply pipe, a water discharging part extending from the connecting part and discharging the water to the ice cube tray, and a projecting part provided in the water discharging part distributing the supplied water.

25 Claims, 5 Drawing Sheets

WATER DISTRIBUTING PIPE FOR ICE MAKING DEVICES OF REFRIGERATORS

CROSS-REFERENCE TO RELATED APPLICATION

This application claims the benefit of Korean Application No. 2002-42622, filed Jul. 19, 2002, in the Korean Intellectual Property Office, the disclosure of which is incorporated herein by reference.

BACKGROUND OF THE INVENTION

1. Field of the Invention

The present invention relates generally to a water distributing pipe for ice making devices of refrigerators, and more particularly, to a water distributing pipe for ice making devices of refrigerators, which is capable of preventing water from being splashed when the water is fed to an ice cube tray.

2. Description of the Related Art

As is well known to those skilled in the art, an automatic ice making device is provided in a freezer compartment of a refrigerator, and freezes water fed from an external water supply source to make ice cubes. After the ice cubes are made in the automatic ice making device, the ice cubes are stacked and stored in an ice container which is installed in the freezer compartment of the refrigerator, through an ice feeding action.

As shown in FIG. 1, an ice making device includes an ice cube tray 103, a drive unit 104, and a sensing lever 106. The ice cube tray 103 is rotatably mounted to a support member 102 which is interiorly fixed to an upper wall of a freezer compartment 101. The drive unit 104 rotates the ice cube tray 103. The sensing lever 106 is connected to the drive unit 104 and senses an amount of ice cubes stored in an ice container 105. A water supply pipe 108 is mounted to a body 107 of the refrigerator, and extends from a water source provided at an outside of the body 107 to an inside of the freezer compartment 101 to supply water to the ice making device. The water supply pipe 108 passes through the external surface of a rear wall of the body 107, and an insulating material provided between outer and inner surfaces of a top wall of the body 107, and extends to the inside of the freezer compartment 101. The end of the water supply pipe 108 in the freezer compartment 101 is connected to a water discharging pipe 109 which extends toward the ice cube tray 103.

In the conventional ice making device, the end of the water discharging pipe 109 is spaced from a top of the ice cube tray 103. As shown in FIG. 2, the water supplied from the water supply pipe 108 flows through a connecting part 201 while strongly and vertically falling along the inner surface of a water discharging part 202. Further, the water is excessively supplied to a specified area of the ice cube tray 103, so the water that strongly falls to the ice cube tray 103 may be splashed or may overflow. The problem becomes more serious due to air existing in the water supply pipe 108 or water discharging pipe 109 or irregular water pressure when the water supply pipe 108 is directly connected to an external water tap. The conventional water discharging pipe 109 for the ice making devices has another problem that splashed water drops are frozen as the splashed water drops contact an area around the ice making device, so the area around the ice making devices become dirty. The conventional water discharging pipe 109 for the ice making devices has a further problem that the water filled in the ice cube tray may overflow, so an amount of the water which is practically frozen is undesirably small, thus an amount of the ice cubes is reduced.

SUMMARY OF THE INVENTION

Accordingly, a water distributing pipe for ice making devices of refrigerators is provided, which has an improved construction capable of preventing water supplied to an ice cube tray from splashing or overflowing.

Additional objects and advantages of the invention will be set forth in part in the description which follows and, in part, will be obvious from the description, or may be learned by practice of the invention.

To accomplish the above and other objects, a water distributing pipe for an ice making device of a refrigerator which comprises an ice cube tray designed such that a top portion is open to receive water into the ice cube tray and opposite ends thereof respectively, are rotatably supported by an inside of a freezer compartment and a water supply pipe supplying water to the ice cube tray, and the water distributing pipe connected to an end of the water supply pipe, distributing water to the ice cube tray, wherein the water distributing pipe comprises a connecting part connected to the water supply pipe, a water discharging part extending from the connecting part and discharging water to the ice cube tray, and a projecting part provided in the water discharging part distributing the supplied water.

Another object is to provide the water distributing pipe, which is cut at an end thereof to have a plurality of cutouts having a predetermined shape, with a plurality of thin protrusions defined by the cutouts and extending from the end of the distributing pipe.

BRIEF DESCRIPTION OF THE DRAWINGS

These and other objects and advantages of the invention will become apparent and more readily appreciated from the following description of the preferred embodiments, taken in conjunction with the accompanying drawings of which.

DESCRIPTION OF THE PREFERRED EMBODIMENTS

Figure 1:
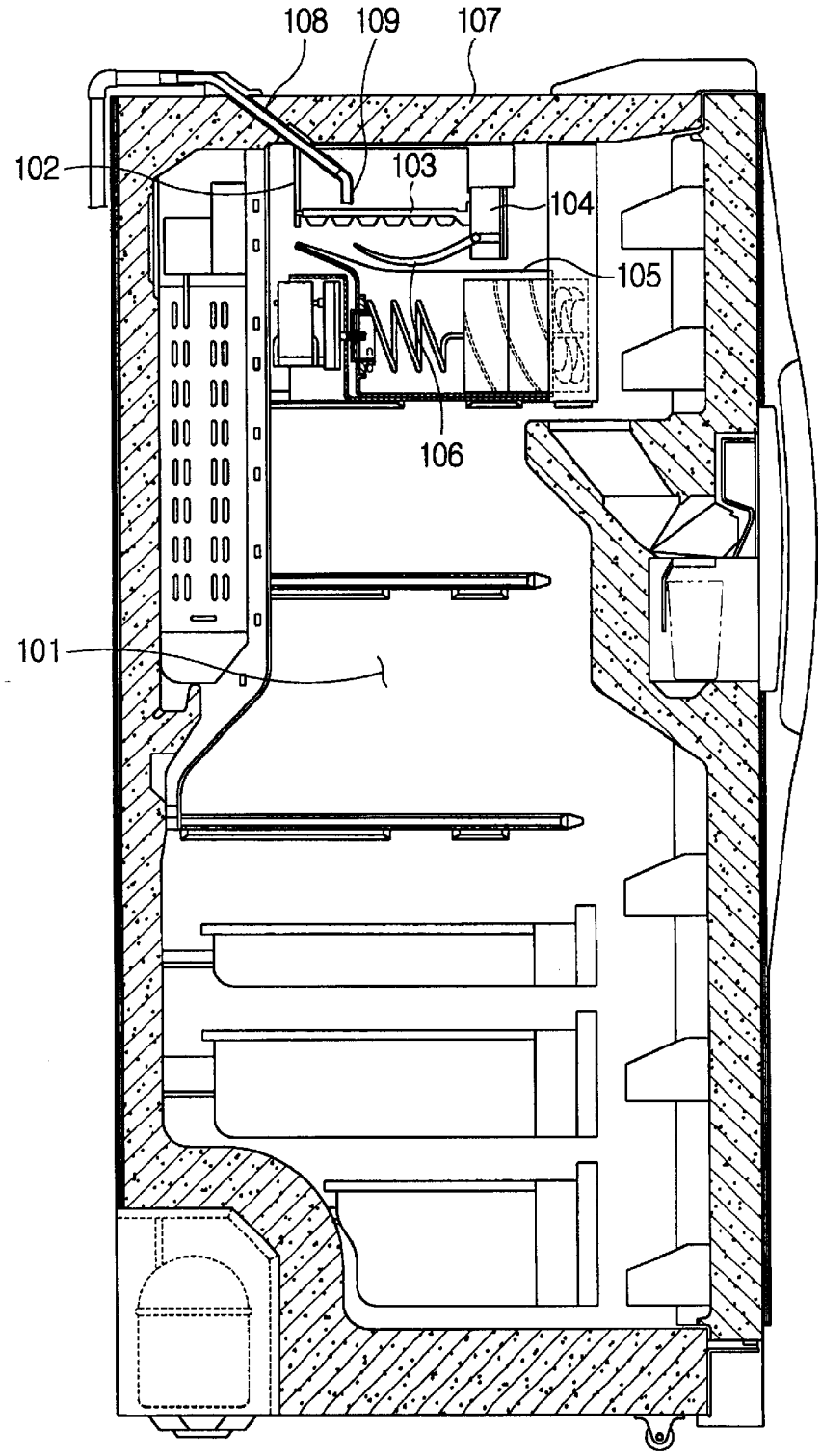
FIG. 1 (PRIOR ART)
FIG. 1 is a sectional view showing a conventional refrigerator which is provided with an ice making device and a water discharging pipe.
Figure 2:
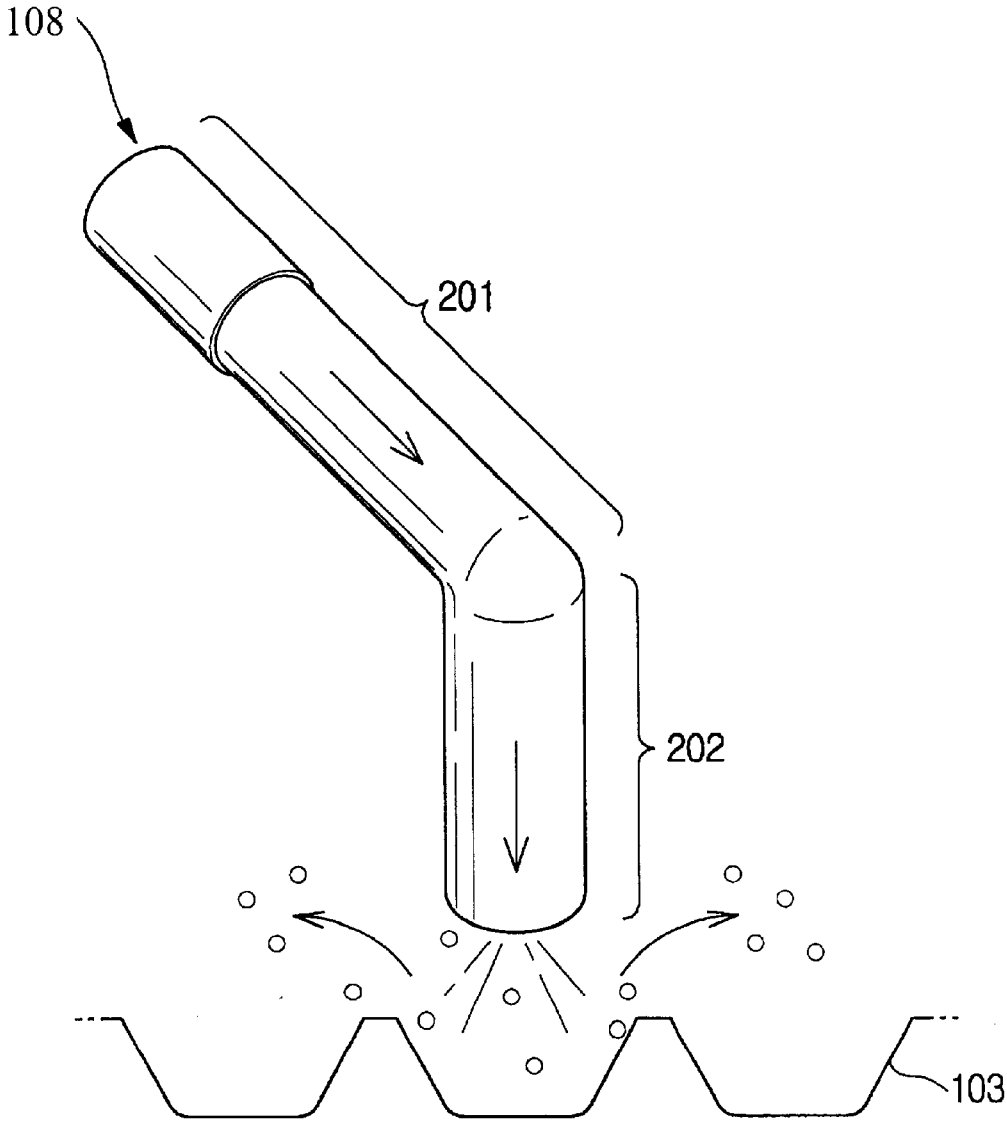
FIG. 2 (PRIOR ART)
FIG. 2 is a perspective view of the water discharging pipe according to FIG. 1.

Reference will now made in detail to the present preferred embodiments of the present invention, examples of which are illustrated in the accompanying drawings, wherein like reference numerals refer to the like elements throughout. The embodiments are described below in order to explain the present invention by referring to the figures.

Figure 3:
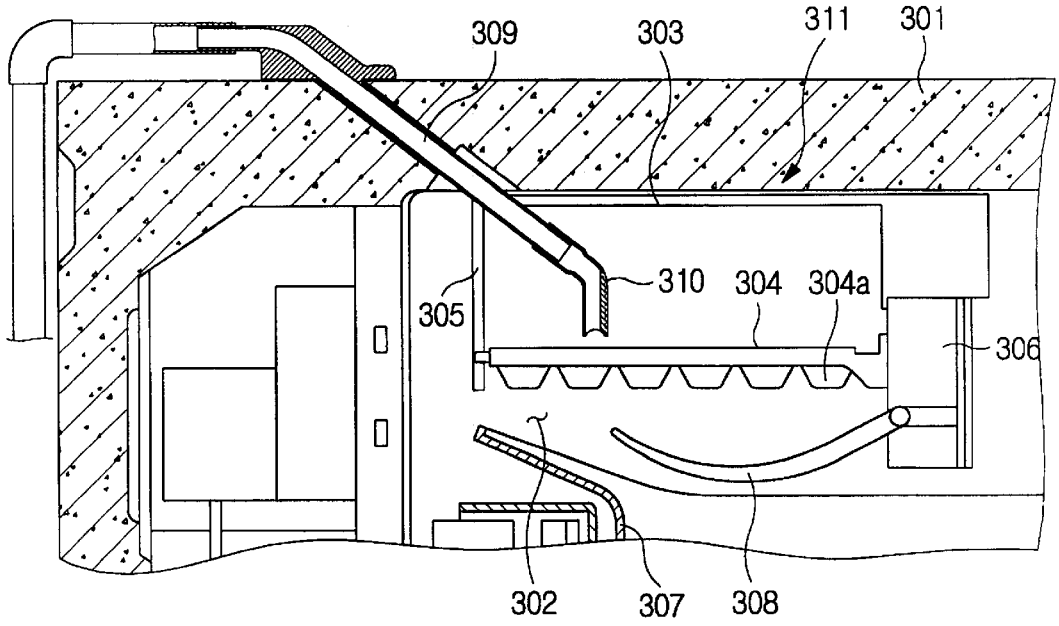
FIG. 3 is a sectional view showing a refrigerator which is provided with a water distributing pipe according to an embodiment of the invention.

As shown in the FIG. 3, the refrigerator is provided in a body 301 thereof with a freezer compartment 302. An ice making device 311 is provided at a predetermined position in the freezer compartment 302 and makes ice cubes. A support member 303 is provided in the freezer compartment 302 to support the ice making device 311 at the freezer compartment 302. An ice cube tray 304, mounted at a position under the support member 303, is open at a top portion thereof to receive water, and comprises a plurality of concave cells 304*a*. Opposite ends of the ice cube tray 304 are rotatably supported by a support plate 305 and a drive unit 306, respectively. The support plate 305 downwardly extends from one end of the support member 303, and the drive unit 306 is mounted to another end of the support member 303. The ice cube tray 304, supported in this way, allows for removal of ice cubes frozen in the concave cells 304*a*, when the ice cube tray 304 is turned upside down by a rotation of the drive unit 306. Further, a drive motor (not shown), a reduction gear (not shown), and several sensing switches (not shown) controlling an operation of the ice making device 311 are provided in the drive unit 306. Further, a sensing lever 308 is rotatably mounted at a predetermined position of the drive unit 306, and senses an amount of the ice cubes stacked in an ice container 307 to control the operation of the ice making device 311.

A water supply pipe 309 is installed so as to pass from an exterior of the body 301 to an interior thereof, and supplies water to the ice cube tray 304. A water distributing pipe 310 is fixedly connected to an end of the water supply pipe 309, guiding water to the ice cube tray 304.

The construction and operation of the water distributing pipe according to the embodiment of the present invention will be described hereinafter with reference to FIGS. 4A and 4B.

Figure 4A:
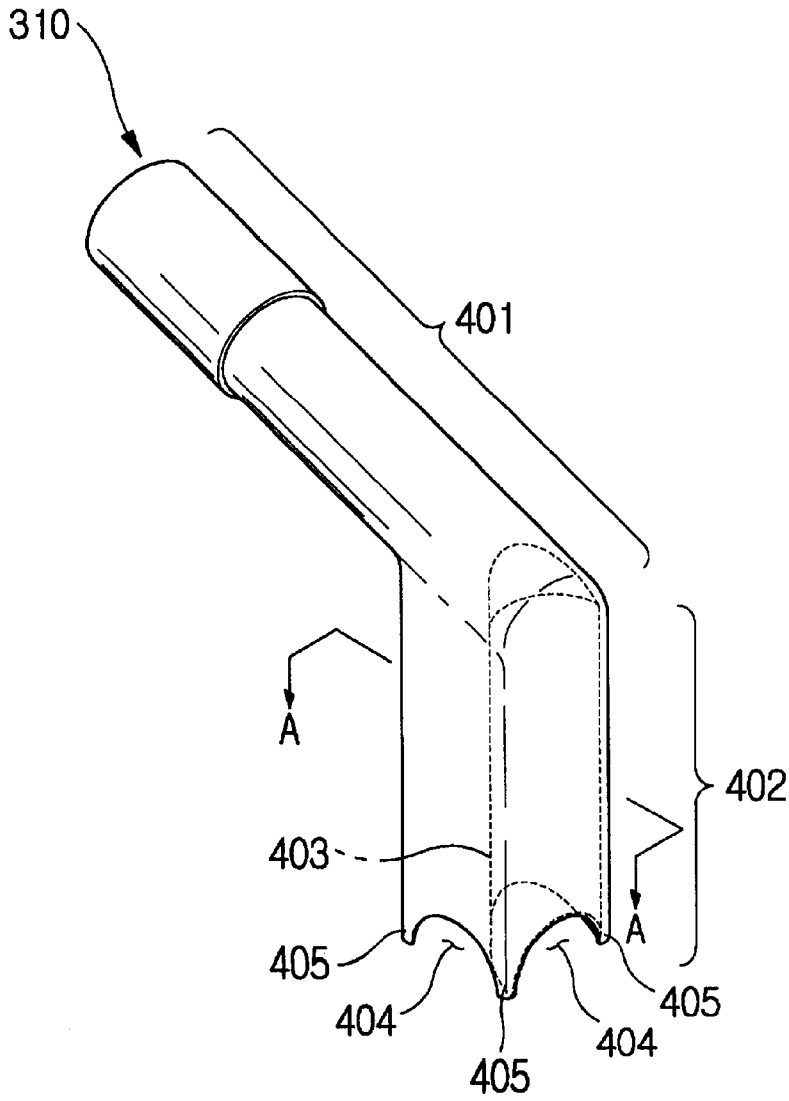
FIG. 4A is a perspective view of the water distributing pipe of FIG. 3.
Figure 4B:
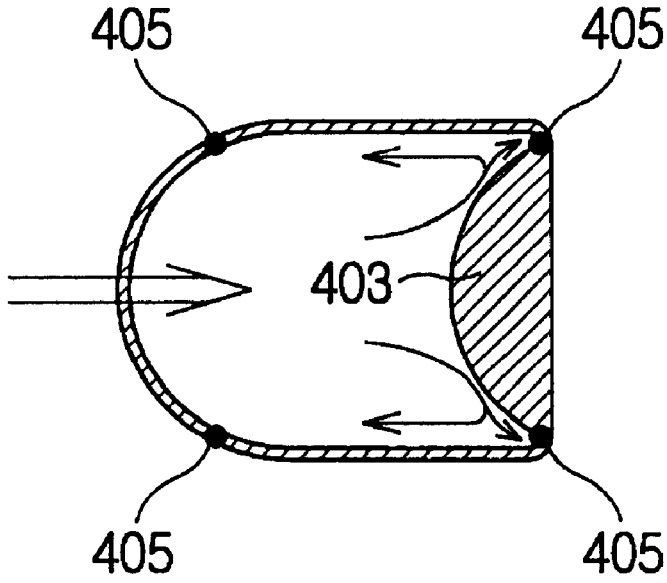
FIG. 4B is a sectional view taken along the line A—A of FIG. 4A.

As shown in FIG. 4A, the water distributing pipe 310 is connected to the end of the water supply pipe 309 to supply the water from a water supply source outside the refrigerator to the ice cube tray 304. The water distributing pipe 310 includes a connecting part 401 which is connected to the water supply pipe 309. A water discharging part 402 extends from the connecting part 401 and discharges the water to the ice cube tray 304. The water discharging part 402 extends downwardly so as to face an interior of the ice cube tray 304, so the water is vertically discharged to the ice cube tray 304. A projecting part 403 is provided in the water discharging part 402 so as to face the water flowing from the connecting part 401 to the water discharging part 402. The projecting part 403 may be formed on a part of an inner surface of the discharging part 402 to entirely cover the part of the inner surface from an upper end to a lower end of the discharging part 402. For ease of illustration, the water discharging part 402 shown in FIG. 4A has a nearly rectangular cross-section with one rounded side, but the cross-section is not limited to the rectangular cross-section shown. The water discharging part 402 may, for example, have an entirely rounded or a triangular cross-section, if the water discharging part 402 is suitable to form the projecting part 403 therein. Further, the projecting part 403 has a semicircular cross-section as shown in FIG. 4A, but the projecting part 403 may have a different cross-section. The projecting part 403 may have various cross-sections, if the various cross-sections allow the water to be distributed into two streams after the water flowing from the connecting part 401 splashes against the projecting part 403. For example, the projecting part 403 may have a triangular cross-section. Further, the projecting part 403 may not extend from the upper end of the discharging part 402 to the lower end of the water discharging part 402.

As shown in FIG. 4A, a lower end of the water distributing pipe 310, that is, the lower end of the water discharging part 402, is specifically cut along the edge to form cutouts 404 of a semicircular shape. Protrusions 405 are defined between two neighboring cutouts 404 at corners of the lower end of the water distributing pipe 310, and extend relatively longer than top portions of the cutouts 404. Since the water discharging part 402 may have another cross-section in place of the rectangular cross-section, the protrusions 405 may not be formed at the corners of rectangular edges. To allow water to converge on the protrusions 405 due to a cohesive force of the water, the protrusions 405 have only to extend slightly downward from the end of the discharge part 402. A shape of the cutouts 404 is not limited to the semicircular shape. For example, the cutouts 404 may be formed to have a triangular shape to effect a desired operation.

An effect of the water distributing pipe 310 constructed in this way will be described with reference to FIG. 4B. FIG. 4B is a sectional view taken along the line A—A of FIG. 4A. The water is supplied from the connecting part 401 in a direction of a thick arrow shown in FIG. 4B. The moving velocity of the water is rapid in a horizontal direction, so a momentum of the water is large in the horizontal direction. Before the water splashes against the projecting part 403 and is discharged from the lower end of the water discharging part 402 of the water distributing pipe 310, the water is divided into two streams by the projecting part 403 in directions of thin arrows shown in FIG. 4B. At that time, the water flows along an inner surface of the water discharging part 402 of the water distributing pipe 310 in the horizontal direction. A part of each of the streams moves to respective edges of the projecting part 403. The water converges on the protrusions 405 extending downward from the end of the water discharging part 402 of the water distributing pipe 310 by the cohesive force and the downward moving velocity of the water. Thereafter, the water falls to the ice cube tray 304. The water falling from the water distributing pipe 310 is divided into four streams at the four protrusions 405. Thus, the water distributing pipe 310 overcomes the problems experienced by the conventional water discharging part, and prevents the water from overflowing or splashing. That is, according to the prior art, the water flows along an inner surface of the water discharging part, so the water is concentrated on an area of the ice cube tray, thus undesirably causing an instantaneous excessive supply of the water.

The projecting part and the protrusions both serve to distribute the water before the water falls to the ice cube tray. However, the projecting part and the protrusions are different from each other in construction and operation. The protrusions guide the water by the cohesive force of the water, while the projecting part divides a velocity of the water flowing in a horizontal direction into two components while distributing the water into two streams. Both the projecting part and the protrusions are provided in the device of the embodiment of the present invention as shown in the drawings, but either of them may be selectively provided therein. However, the water distributing pipe having both the projecting part and the protrusions, as shown in FIG. 4A, is more efficient.

As described above, a water distributing pipe for ice making devices of refrigerators is provided, which distributes water when supplying the water to an ice cube tray, thus preventing the water from overflowing or splashing due to a concentrated dropping of the water. Problems caused by the overflow of the water are eliminated, such as massed ice cubes or a reduction in an amount of the ice cubes. Further, problems caused by splashing of the water drops are eliminated, such as contacting of the splashed water drops in an area around the ice making device and freezing of the contacted water drops thereto, thus keeping the area around the ice making device clean, and thereby enhancing an operational reliability of the refrigerator.

Although a few preferred embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A water distributing pipe for an ice making device of a refrigerator, said refrigerator comprising an ice cube tray provided such that a top portion of said ice cube tray is open to receive water into the ice cube tray and opposite ends of said tray are rotatably supported to an inside of a freezer compartment, and a water supply pipe supplying water to the ice cube tray, and said water distributing pipe connected to an end of said water supply pipe distributing water to the ice cube tray, wherein said water distributing pipe comprises:

a connecting part connected to the water supply pipe;

a water discharging part extending from the connecting part and discharging water to the ice cube tray; and a projecting part provided in the water discharging part distributing the supplied water such that a cross-section of the projecting part produces substantially two or more streams of the supplied water to be supplied from an end of the water discharging part.

2. The water distributing pipe according to claim 1, wherein said water discharging part is cut at an end thereof to have a plurality of cutouts having a predetermined shape, with a plurality of thin protrusions defined by the cutouts and extending from the end of the water discharging part.

3. The water distributing pipe according to claim 1, wherein said projecting part is provided on a part of a surface of the discharging part to entirely cover the part of the surface in a water flowing direction.

4. The water distributing pipe according to claim 3, wherein said projecting part has a rounded cross-section which is convex toward an inside of the discharge part.

5. A water distributing pipe for an ice making device of a refrigerator, said refrigerator comprising an ice cube tray provided such that a top portion of said ice cube tray is open to receive water and opposite ends of said ice cube tray are rotatably supported to an inside of a freezer compartment, and a water supply pipe supplying water to the ice cube tray, and said water distributing pipe connected to an end of said water supply pipe distributing water to the ice cube tray, wherein said water distributing pipe is cut at an end thereof to have a plurality of cutouts having a predetermined shape disposed along a circumference of the distributing pipe, with a plurality of thin protrusions defined by the cutouts and extending from the end of the distributing pipe.

6. The water distributing pipe according to claim 5, wherein the shape of said cutouts is a semicircular shape.

7. A water distributing pipe of a refrigerator, the refrigerator having an ice cube tray, the water distributing pipe to receive water from a water supply, comprising:

a connecting part connected to and receiving water from the water supply;

a water discharging part extending from the connecting part and discharging the water to the ice cube tray; and a projecting part provided in the water discharging part distributing the supplied water such that a cross-section of the projecting part produces substantially two or more streams of the supplied water to be supplied from an end of the water discharging part.

8. The water distributing pipe according to claim 7, wherein the water discharging part comprises:

a plurality of cutouts at one end of the water discharging part, each having a predetermined shape; and a plurality of protrusions defined by the plurality of cutouts and each of the plurality of protrusion extending from the one end of the water discharging part.

9. The water distributing pipe according to claim 7, wherein the water discharging part comprises:

a plurality of protrusions, each of the plurality of protrusions extending from the one end of the water discharging part.

10. The water distributing pipe according to claim 7, wherein the projecting part is provided on a portion of an inner surface of the discharging part.

11. The water distributing pipe according to claim 7, wherein the projecting part is a shape such that the supplied water is distributed substantially as the two or more streams of the supplied water.

12. The water distributing pipe according to claim 7, wherein the projecting part adjusts velocities of the water in the water discharging part such that the supplied water is distributed substantially as the two or more streams of the supplied water.

13. The water distributing pipe according to claim 7, wherein the projecting part provides the supplied water substantially as the two or more streams of the water by the water from the connecting part splashing against the projecting part.

14. The water distributing pipe according to claim 7, wherein the projecting part has a triangular cross-section.

15. The water distributing pipe according to claim 8, wherein the projecting part is a shape such that the supplied water is distributed substantially as the two or more streams of the supplied water.

16. The water distributing pipe according to claim 15, wherein the protrusions are provided at discrete locations corresponding to respective exit locations of the streams of the supplied water to guide the supplied water to the ice cube tray and substantially prevent splashing of the supplied water.

17. A water distributing pipe of a refrigerator, the refrigerator having an ice cube tray, the water distributing pipe to receive water from a water supply, comprising:

a connecting part connected to and receiving water from the water supply;

a water discharging part extending from the connecting part and discharging the water to the ice cube tray; and a protecting part provided in the water discharging part distributing the supplied water, wherein the projecting part has a rounded cross-section which is convex toward an inside of the discharge part.

18. A water distributing pipe of a refrigerator, the refrigerator having an ice cube tray, the water distributing pipe to receive water from a water supply and to distribute the water to the ice cube tray, comprising:

a plurality of protrusions extending from one end of the water distributing pipe along a circumference of the distributing pipe to guide the water to the ice cube tray and substantially prevent splashing of the supplied water.

19. The water distributing pipe according to claim 18, wherein the protrusions are of a shape to concentrate the water at the protrusions by cohesion of the water to the protrusions.

20. A water distributing pipe of a refrigerator, the refrigerator having an ice cube tray, the water distributing pipe to receive water from a water supply and to distribute the water to the ice cube tray, comprising:

a plurality of protrusions extending from one end of the water distributing pipe to guide the water to the ice cube tray and substantially prevent splashing of the supplied water, wherein the water distributing pipe has a nearly rectangular shape cross-section with one rounded side and the protrusions are formed at locations corresponding to corners of the nearly rectangular shape cross-section.

21. A water distributing pipe of a refrigerator, the refrigerator having an ice cube tray, the water distributing pipe to receive water from a water supply, comprising:

a connecting part connected to and receiving water from the water supply;

a water discharging part extending from the connecting part and discharging the water to the ice cube tray;

a plurality of cutouts at one end of the water discharging part, each having a predetermined shape disposed along a circumference of the water distributing part; and a plurality of protrusions defined by the plurality of cutouts and each of the plurality of protrusion extending from the one end of the water discharging part.

22. The water distributing pipe according to claim 21, wherein the shape of the cutouts is a semicircular shape.

23. The water distributing pipe according to claim 21, wherein the protrusions are of a shape to concentrate the water at the protrusions by cohesion of the water to the protrusions.

24. A water distributing pipe of a refrigerator, the refrigerator having an ice cube tray, the water distributing pipe to receive water from a water supply, comprising:

a connecting part connected to and receiving water from the water supply;

a water discharging part extending from the connecting part and discharging the water to the ice cube tray; and a water directing part provided at the water discharging part to direct the supplied water such that a cross-section of the water directing part produces substantially two or more streams of the supplied water to be supplied from an end of the water discharging part to prevent splashing or overflowing of the supplied water from the ice cube tray.

25. The water distributing pipe according to claim 24, wherein the water directing part comprises one or more than one of a plurality of protrusions at one end of the discharging part and of a projecting part provided in the water discharging part distributing the supplied water.

* * * * *